US005443745A

United States Patent [19]

Sakamoto et al.

[11] Patent Number: 5,443,745

[45] Date of Patent: Aug. 22, 1995

[54] LUBRICANT FOR REFRIGERATING MACHINE

[75] Inventors: Tetsuro Sakamoto, Yokohama; Motoshi Sunami, Nerima; Hiroshi Hasegawa, Yokohama, all of Japan

[73] Assignee: Nippon Oil Co., Ltd., Japan

[21] Appl. No.: 132,237

[22] Filed: Oct. 6, 1993

Related U.S. Application Data

[63] Continuation of Ser. No. 892,668, Jun. 3, 1992, abandoned, which is a continuation of Ser. No. 687,770, Apr. 18, 1991, abandoned, which is a continuation of Ser. No. 564,190, Aug. 8, 1990, abandoned.

[30] Foreign Application Priority Data

Aug. 11, 1989 [JP] Japan ..... 1-206660

[51] Int. Cl.[6] ..... C10M 105/18

[52] U.S. Cl. ..... 252/52 A; 252/67; 252/68; 252/58; 62/114

[58] Field of Search ..... 252/52 A, 67, 68, 58; 62/114

[56] References Cited

U.S. PATENT DOCUMENTS

| | | | |
|---|---|---|---|
| 2,552,084 | 5/1951 | Bishop et al. | 252/68 |
| 3,214,390 | 10/1965 | Vandenberg | 252/54 |
| 4,077,895 | 3/1978 | Langdon | 252/77 |
| 4,190,567 | 2/1980 | Ohmura et al. | 525/423 |
| 4,248,726 | 2/1981 | Uchinuma | 252/68 |
| 4,267,064 | 5/1981 | Sasaki et al. | 252/58 |
| 4,431,557 | 2/1984 | Shimizu et al. | 252/52 A |
| 4,755,316 | 7/1988 | Magid et al. | 252/52 A |
| 4,851,144 | 7/1989 | McGraw et al. | 252/68 |
| 4,900,463 | 2/1990 | Thomas et al. | 252/68 |
| 5,080,816 | 1/1992 | Sakamoto et al. | 252/52 A |

*Primary Examiner*—Margaret Medley
*Attorney, Agent, or Firm*—Cushman Darby & Cushman

[57] ABSTRACT

A lubricant for a refrigerating machine is here disclosed which comprises a polyoxyalkylene glycidyl ether represented by the general formula

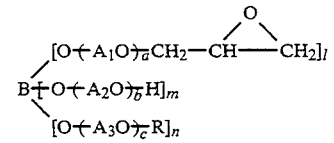

wherein B is a residue of a compound having 2 to 8 hydroxyl groups, $A_1O$, $A_2O$ and $A_3O$ may be identical or different, each of them is an oxyalkylene group having 2 to 18 carbon atoms, R is a hydrocarbon group having 1 to 24 carbon atoms, a is an integer of from 1 to 100, b is an integer of from 1 to 100, c is an integer of from 1 to 100, l is an integer of from 1 to 8, m is an integer of from 0 to 7, n is an integer of from 0 to 7, and l+m+n is an integer of from 2 to 8.

The above-mentioned lubricant is excellent in stability in the presence of a FLON refrigerant.

6 Claims, No Drawings

LUBRICANT FOR REFRIGERATING MACHINE

This is a continuation of application No. 07/892,668, filed on Jun. 3, 1992, which was abandoned upon the filing hereof which is a cont. of 07/687,770 filed Apr. 18, 1991 (abandoned) which is a cont. of 07/564,190 filed Aug. 8, 1990 (abandoned).

BACKGROUND OF THE INVENTION

1. Field of the Invention

The present invention relates to a lubricant for a refrigerating machine, and more specifically, it relates to a lubricant for a refrigerating machine, which comprises a polyglycol having a specific structure or contains the same as a main component and which is stable in the presence of a FLON refrigerant.

2. Description of the Prior Art

As compressors for refrigerating machines using a FLON refrigerant, there have been used reciprocating, centrifugal and rotary type compressors. Particularly, in recent years, the EER (energy efficiency rate) of the compressor is heightened, and therefore the temperature in the exhaust port of this kind of compressor is high, so that thermal load to a lubricant is also large. For this reason, the stability of the lubricant under a refrigerant atmosphere is very important to maintain the performance of the lubricant itself.

Examples of the lubricant which has been heretofore used together with a FLON refrigerant include mineral oils such as a naphthene and a paraffin as well as synthetic oils such as an alkylbenzene, a poly-$\alpha$-olefin and a polyglycol. However, in view of the above-mentioned high performance which is required in the refrigerating machine of late, it is considered that the stability of the lubricant at a high temperature is not always sufficient, when the aforesaid base oil is used singly. In particular, a polyglycol oil is excellent in viscosity properties and is also preferable as the lubricant for the rotary compressor because of good sealing properties at high temperatures and good flowability at low temperatures. In addition, the polyglycol oil is also excellent in solubility in HFC-134a which is expected as the replaceable refrigerant under the recent FLON regulation. However, the single use of the polyglycol oil is not reliable, since this kind of oil tends to deteriorate due to the coexisting FLON refrigerant.

On the other hand, for the purpose of improving the stability of the lubricant in the presence of the FLON refrigerant, it is known to add, to the lubricant, an epoxy compound such as a phenyl glycidyl ether, an epoxidized aliphatic acid monoester or an epoxidized vegetable oil (Japanese Patent Laid-open No. 49-97351 and Japanese Patent Publication No. 57-42119, etc.). According to the description of these publications, it is elucidated that the compound added functions to trap an acid produced by the decomposition of the refrigerant.

SUMMARY OF THE INVENTION

The present inventors have paid much attention to the function of the above-mentioned compounds and have repeated researches, and as a result, they have found that a polyglycol having a specific structure is excellent in stability, even when used singly in the presence of a FLON refrigerant, and that it has excellent viscosity properties and good solubility in the refrigerant. The present invention has been achieved on the basis of the above-mentioned knowledge.

An object of the present invention is to provide a lubricant for a refrigerating machine having excellent viscosity properties and good solubility in a refrigerant and having excellent stability that a conventional polyglycol cannot obtain.

That is, the present invention is directed to a lubricant for a refrigerating machine which comprises a polyoxyalkylene glycidyl ether represented by the general formula

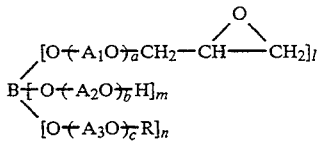

wherein B is a residue of a compound having 2 to 8 hydroxyl groups, $A_1O$, $A_2O$ and $A_3O$ may be identical or different, each of them is an oxyalkylene group having 2 to 18 carbon atoms, R is a hydrocarbon group having 1 to 24 carbon atoms, a is an integer of from 1 to 100, b is an integer of from 1 to 100, c is an integer of from 1 to 100, l is an integer of from 1 to 8, m is an integer of from 0 to 7, n is an integer of from 0 to 7, and $l+m+n$ is an integer of from 2 to 8.

The lubricant for a refrigerating machine of the present invention exhibits satisfactory physical and chemical characteristics such as viscosity properties, solubility in a refrigerant and the like which are required for the lubricant, and particularly it should be noted that the lubricant of the present case is excellent in stability in the presence of a FLON refrigerant.

DETAILED DESCRIPTION OF THE INVENTION

Now, the present invention will be described in more detail.

A lubricant for a refrigerating machine of the present invention is characterized by comprising a polyoxyalkylene glycidyl ether represented by the general formula:

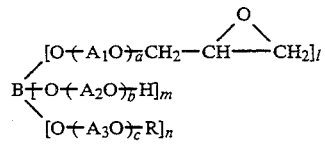

In the formula, B is a residue of a compound having 2 to 8 hydroxyl groups.

Furthermore, each of $A_1O$, $A_2O$ and $A_3O$ is an oxyalkylene group having 2 to 18 carbon atoms, and R is a hydrocarbon group having 1 to 24 carbon atoms. Each of a, b and c is an integer of from 1 to 100, l is an integer of from 1 to 8, m is an integer of from 0 to 7, each of l, m and n is an integer of from 0 to 7, and the total of l, m and n is an integer of from 2 to 8.

Typical examples of the compound having 2 to 8 hydroxyl groups whose residue is represented by B include polyhydric alcohols such as ethylene glycol, propylene glycol, butylene glycol, trimethylene glycol, tetramethylene glycol, pentamethylene glycol, hexamethylene glycol, heptamethylene glycol, octamethylene glycol, dodecylene glycol, octadecylene glycol, diethylene glycol, neopentyl glycol, styrene glycol, glycerin, diglycerin, polyglycerin, trimethylolethane, trimethylolpropane, 1,3,5-pentanetriol, erythritol, pentaerythritol, dipentaerythritol, sorbitol, sorbitan, sorbite, sorbitol glycerin condensate, adonitol, arabitol, xylitol and mannitol; polyhydric phenols such as catechol, resorcin, hydroquinone and phloroglucin; saccharoses such as xylose, arabinose, ribose, rhamnose, glucose, fructose, galactose, mannose, sorbose, cellobiose, maltose, isomaltose, trehalose, sucrose, raffinose, gentianose and melezitose, and partial ether compounds and partial ester compounds thereof.

Furthermore, examples of $A_1O$, $A_2O$ and $A_3O$ include an oxyethylene group, oxypropylene group, oxytrimethylene group, oxybutylene group, 1,2-dimethyloxyethylene group, 1-methyloxytrimethylene group, 2-methyloxytrimethylene group, oxytetramethylene group, oxypentamethylene group, oxyhexamethylene group, oxyheptamethylene group, oxyoctamethylene group, oxynonamethylene group, oxydecamethylene group, oxyundecamethylene group, oxydodecamethylene group, oxytridecamethylene group, oxytetradecamethylene group, oxypentadecamethylene group, oxyhexadecamethylene group, oxyheptadecamethylene group and oxyoctadecamethylene group. Above all, the oxyethylene group, oxypropylene group and oxybutylene group and oxytetramethylene group are more preferable.

Moreover, typical examples of R include various hydrocarbon groups, for example, alkyl groups each having a straight-chain or a branched structure such as a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, eicosyl group, heneicosyl group, docosyl group, tricosyl group and tetracosyl group; alkenyl groups each having a straight-chain or a branched structure such as an ethenyl group, propenyl group, butenyl group, pentenyl group, hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, eicosenyl group, heneicosenyl group, docosenyl group, tricosenyl group and tetracosenyl group; cycloalkyl groups such as a cyclohexyl group, methylcyclohexyl group and ethylcyclohexyl group; and aromatic groups such as a phenyl group, methylphenyl group, ethylphenyl group, propylphenyl group, butylphenyl group, pentylphenyl group, hexylphenyl group, heptylphenyl group, octylphenyl group, nonylphenyl group, decylphenyl group, undecylphenyl group, dodecylphenyl group, tridecylphenyl group, tetradecylphenyl group, pentadecylphenyl group, hexadecylphenyl group, heptadecylphenyl group, octadecylphenyl group, naphthyl group, methylnaphthyl group, ethylnaphthyl group, propylnaphthyl group, butylnaphthyl group, pentylnaphthyl group, hexylnaphthyl group, heptylnaphthyl group, octylnaphthyl group, nonylnaphthyl group, decylnaphthyl group, undecylnaphthyl group, dodecylnaphthyl group, tridecylnaphthyl group and tetradecylnaphthyl group.

In one molecule of the polyoxyalkylene glycidyl ether regarding the present invention or in one polyoxyalkylene chain, oxyalkylene groups having different numbers of carbon atoms may be present. In this case, the oxyalkylene group in the one polyoxyalkylene chain may be combined by random copolymerization or block copolymerization.

No particular restriction is put on the molecular weight of the polyoxyalkylene glycidyl ether, but for the improvement of sealing properties of the compressor, the ether having a number average molecular weight of from 200 to 4,000 is preferably used, and a number average molecular weight of from 300 to 3,500 is more preferable.

As the lubricant for a refrigerating machine of the present invention, there may be used the above-mentioned polyoxyalkylene glycidyl ether singly, but a known base oil for a refrigerating machine may be mixed therewith, if necessary. Examples of the preferable base oil include polyglycol oils such as polyoxylakylene glycol, polyoxyalkylene glycol monoether, polyoxyalkylene glycol diether and polyoxyalkylene glycol glycerol ether, and other oils can also be used which are mineral oils such as a paraffin and a naphthene as well as poly-$\alpha$-olefins and alkylbenzenes. These oils may be used singly or in the form of a mixture of several kinds thereof.

No particular restriction is put on the amount of the above-mentioned base oil to be blended, so long as it is not such as to impair the excellent performance of the lubricant for a refrigerating machine of the present invention. However, the amount of the base oil is usually 50% by weight or less, preferably 30% by weight or less based on the total weight of the lubricant.

In addition, for the purpose of further improving the performance of the lubricant for a refrigerating machine of the present invention, known additives for refrigerating machine oils can be blended, if necessary. Examples of these additives include a phenol antioxidant such as di-tert-butyl-p-cresol or an amine antioxidant such as phenyl-$\alpha$-naphthylamine or N,N'-di(2-naphthyl)-p-phenylenediamine; a wear inhibitor such as zinc dithiophosphate, a phosphate or chlorinated phosphate; an extreme pressure additive such as a chlorinated paraffin or a material containing sulfur; an oiliness improver such as a fatty acid; an anti-foaming agent such as a silicone material; a metal inactivating agent such as benzotriazole; and a hydrochloric acid trapping agent such as a phenyl glycidyl ether, an epoxidized aliphatic acid ester, an epoxidized vegetable oil, a glycidyl methacrylate or a phosphite. They can be blended singly or in the form of a mixture of several kinds thereof.

The amount of the additives to be blended is usually 10% by weight or less, preferably 5% by weight or less based on the total weight of the lubricant.

The lubricant for a refrigerating machine of the present invention which comprises a polyoxyalkylene glycidyl ether should have about the same kinematic viscosity and pour point as the usual oil for a refrigerating machine has. However, in order to prevent the solidification of the lubricant at a low temperature, it is desirable that the pour point is −10° C. or less, preferably in the range of from −20° to −50° C. Furthermore, in order to maintain sealing properties of a compressor, it is desirable that the kinematic viscosity of the lubricant is 2 cSt or more, preferably 3 cSt or more at 100° C. Considering flowability at a low temperature and the efficiency of heat exchange in a carburetor, the kinematic viscosity of the lubricant is desirably 50 cSt or less, preferably 20 cSt or less at 100° C.

The lubricant for a refrigerating machine of the present invention can be used particularly preferably in a cooling device of an air conditioner, a dehumidifier, a refrigerator, a freezer, a freezing and refrigerating chamber, an automatic vending machine, a showcase or a chemical plant having a reciprocating or a rotary type compressor. The lubricant of the present case can also be used preferably in a device having a centrifugal type compressor.

Now, the present invention will be described in more detail in reference to examples and comparative examples.

EXAMPLES 1 TO 4 AND COMPARATIVE EXAMPLES 1 TO 3

Table 1 shows the kinematic viscosities and pour points of lubricants for refrigerating machines used in examples and comparative examples.

For these lubricants for refrigerating machines, stability was evaluated in accordance with the following sealed tube test, and the results are also set forth in Table 1.

SEALED TUBE TEST

A mixture of a sample oil and a refrigerant in an equal volume was placed together with catalysts of iron, copper and aluminum in a glass tube, and the latter was then sealed up. Afterward, the tube was heated at 175° C. for 168 hours, and color change of the oil and the catalysts was observed to make evaluation.

The color change of the oil was classified into 9 ranks, blackish brown being 8, a colorless state being 0. Furthermore, with regard to the color change of the metal catalysts, a degree such as the loss of their luster meant no problem, but when the iron catalyst was plated with copper, it was meant that the oil was bad.

TABLE 1

| Example & Comp. Ex. | Lubricant for Refrigerating Machine | Kinematic[1] Viscosity @ 100° C. cSt | Pour[2] Point °C. |
|---|---|---|---|
| Example 1 | Polyoxypropylene glycol monoglycidyl ether[3] | 5.1 | −52.5 |
| Example 2 | Polyoxyethyleneoxy-propylene glycol monoglycidyl ether[4] | 26.7 | −35 |
| Example 3 | Polyoxypropylene glycol diglycidyl ether[5] | 9.2 | −42.5 |
| Example 4 | Polyoxyethylene-oxypropylene glycol diglycidyl ether[6] | 44.54 | −32.5 |
| Example 5 | Glycerin derivative[7] | 12.3 | −42.5 |
| Example 6 | Pentaerythritol derivative[8] | 18.5 | −32.5 |
| Comp. Ex. 1 | Polyoxypropylene glycol monobutyl ether | 6.9 | −47.5 |
| Comp. Ex. 2 | Polyoxyethyleneoxy-propylene glycol monobutyl ether | 10.7 | −45 |
| Comp. Ex. 3 | Naphthene mineral oil | 7.8 | −22.5 |

| | Sealed Tube Test | | |
|---|---|---|---|
| Example & Comp. Ex. | Refrig-erant | Appearance of Sample Oil | Appearance of Catalyst (Fe) |
| Example 1 | R12 | 4 | Luster decreased |
| | R22 | 1 | Unchanged |
| Example 2 | R12 | 4 | Luster decreased |
| | R22 | 1 | Unchanged |
| Example 3 | R12 | 3 | Luster decreased |
| | R22 | 0 | Unchanged |
| Example 4 | R12 | 4 | Luster decreased |
| | R22 | 1 | Unchanged |
| Example 5 | R12 | 4 | Luster decreased |
| | R22 | 1 | Unchanged |
| Example 6 | R12 | 3 | Luster decreased |
| | R22 | 0 | Unchanged |
| Comp. Ex. 1 | R12 | 8 or more | Changed into black |
| | R22 | 4 | Plated with copper |
| Comp. Ex. 2 | R12 | 8 or more | Changed into black |
| | R22 | 4 | Plated with copper |
| Comp. Ex. 3 | R12 | 4 | Plated with copper |
| | R22 | 2 | Plated with copper |

[1]It was measured in accordance with JIS K 2283
[2]It was measured in accordance with JIS K 2269

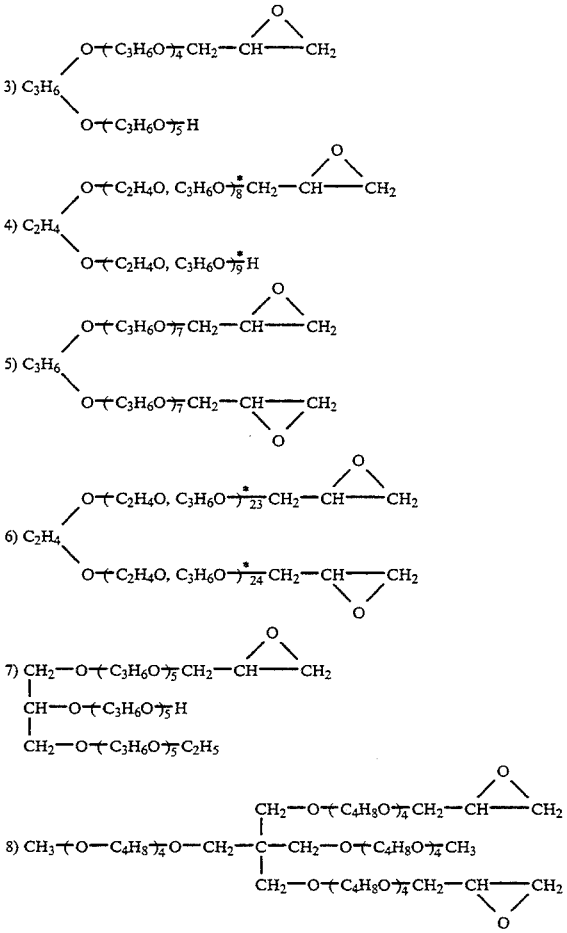

Here, * represents a random copolymerization, and the molar ratio of $C_2H_4O/C_3H_6O$ was 1/1.

The results in Table 1 indicate that the lubricants for refrigerating machines regarding the present invention are excellent in stability in the presence of the FLON refrigerant. On the contrary, in the cases of the lubricants for refrigerating machines in the comparative examples, the color of the catalysts changes into black or they were plated with copper.

As understood from the foregoing, the lubricant for a refrigerating machine of the present invention has the excellent stability under the FLON refrigerant and other various excellent performances.

What is claimed is:

1. A refrigerant lubricant for a refrigerating machine which comprises:

50 wt % or less of a base oil selected from the group consisting of polyglycol oils, minerals oils, poly-α-olefins and alkylbenzenes; and 50–100 wt % of a polyoxyalkylene glycidyl ether represented by the general formula

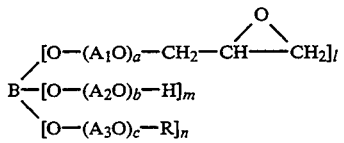

wherein B is a residue of a compound having 2 to 8 hydroxyl groups, $A_1O$, $A_2O$, and $A_3O$ each is an oxyalkylene group having 2 to 18 carbon atoms, R is a hydrocarbon group having 1 to 24 carbon atoms, a is an integer of from 1 to 100, b is an integer of from 1 to 100, c is an integer of from 1 to 100, l is an integer of from 1 to 8, m is an integer of from 0 to 7, n is an integer of from 0 to 7, and l+m+n is an integer of from 2 to 8, and wherein said glycidyl ether has a pour point of −10° C. or less and a kinematic viscosity of from 2 to 50 cSt at 100° C.

2. The lubricant according to claim 1, further comprising at least one additive in an amount of 10 weight percent or less based on the total weight of said lubricant, said additive is selected from the group consisting of an antioxidant, a wear inhibitor, an extreme pressure additive, an oiliness improver, an anti-foaming agent, a metal inactivating agent, and a hydrochloric acid trapping agent.

3. The lubricant for a refrigerating machine according to claim 1, wherein said polyoxyalkylene glycidyl ether has a number average molecular weight of from 200 to 4,000.

4. A method for improving lubrication in a refrigerating machine, said method comprising using in said refrigerating machine a lubricant which has a pour point of −10° C. or less, a kinematic viscosity of from 2 to 50 cSt at 100° C., and which comprises;

50 wt % or less of a base oil selected from the group consisting of polyglycol oils, minerals oils, poly-α-olefins and alkylbenzenes; and 50–100 wt % of a polyoxyalkylene glycidyl ether represented by the general formula,

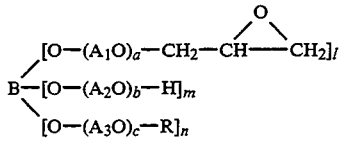

wherein B is a residue of a compound having 2 to 8 hydroxyl groups, $A_1O$, $A_2O$, and $A_3O$ each is an oxyalkylene group having 2 to 18 carbon atoms, R is a hydrocarbon group having 1 to 24 carbon atoms, a is an integer of from 1 to 100, b is an integer of from 1 to 100, c is an integer of from 1 to 100, is an integer of from 1 to 8, m is an integer of from 0 to 7, n is an integer of from 0 to 7, and +m+n is an integer of from 2 to 8.

5. The method according to claim 4, wherein said polyoxyalkylene glycidyl ether has a number average molecular weight of from 200 to 4,000.

6. The method according to claim 4, wherein said lubricant further comprises at least one additive in an amount of 10 weight percent or less based on the total weight of said lubricant, said additive is selected from the group consisting of an antioxidant, a wear inhibitor, an extreme pressure additive, an oiliness improver, an anti-foaming agent, a metal inactivating agent, and a hydrochloric acid trapping agent.

* * * * *